US005078506A

United States Patent [19]

Tischer

[11] Patent Number: 5,078,506

[45] Date of Patent: Jan. 7, 1992

[54] BOTTOM ENTRY MIXER SHAFT SEAL SYSTEM FOR PROCESS VESSELS

[75] Inventor: Ronald R. Tischer, Stoddard, Wis.

[73] Assignee: G. Heileman Brewing Company, Inc., La Crosse, Wis.

[21] Appl. No.: 682,095

[22] Filed: Apr. 5, 1991

[51] Int. Cl.[5] ..... B01F 7/20

[52] U.S. Cl. ..... 366/314; 366/286; 277/58; 277/64; 277/105; 277/212 FB

[58] Field of Search ..... 366/149, 205, 314, 286; 277/58, 59, 3, 152, 205, 212 FB, 64, 102, 105

[56] References Cited

U.S. PATENT DOCUMENTS

| | | | |
|---|---|---|---|
| 2,354,478 | 7/1944 | Reinhardt | 277/58 |
| 2,773,680 | 12/1956 | Zozulin | 366/314 |
| 3,106,099 | 10/1963 | Jeffrey | 277/3 |
| 3,606,260 | 10/1971 | Rubin | 277/64 |
| 4,378,119 | 3/1983 | Luxford | 277/3 |
| 4,384,788 | 5/1983 | Lenart | 366/314 |
| 4,732,396 | 3/1988 | Brigham | 277/3 |
| 4,765,631 | 8/1988 | Kohnen | 277/59 |

*Primary Examiner*—Timothy F. Simone
*Assistant Examiner*—Randall E. Chin
*Attorney, Agent, or Firm*—Hill, Van Santen, Steadman & Simpson

[57] ABSTRACT

A sealing system for a process vessel of the type having a bottom entry mixer shaft includes a motion seal around an exterior portion of the mixer shaft and a mechanical seal around the mixer shaft at the bottom wall of the vessel. The two seals are interconnected by a cylindrical tubular bellows expansion piece having an upper rigid ring containing a "TEFLON" bushing. A water flushing system is supplied to the bushing and to the motion seal to flush abrasive grit away from the mixer shaft.

5 Claims, 3 Drawing Sheets

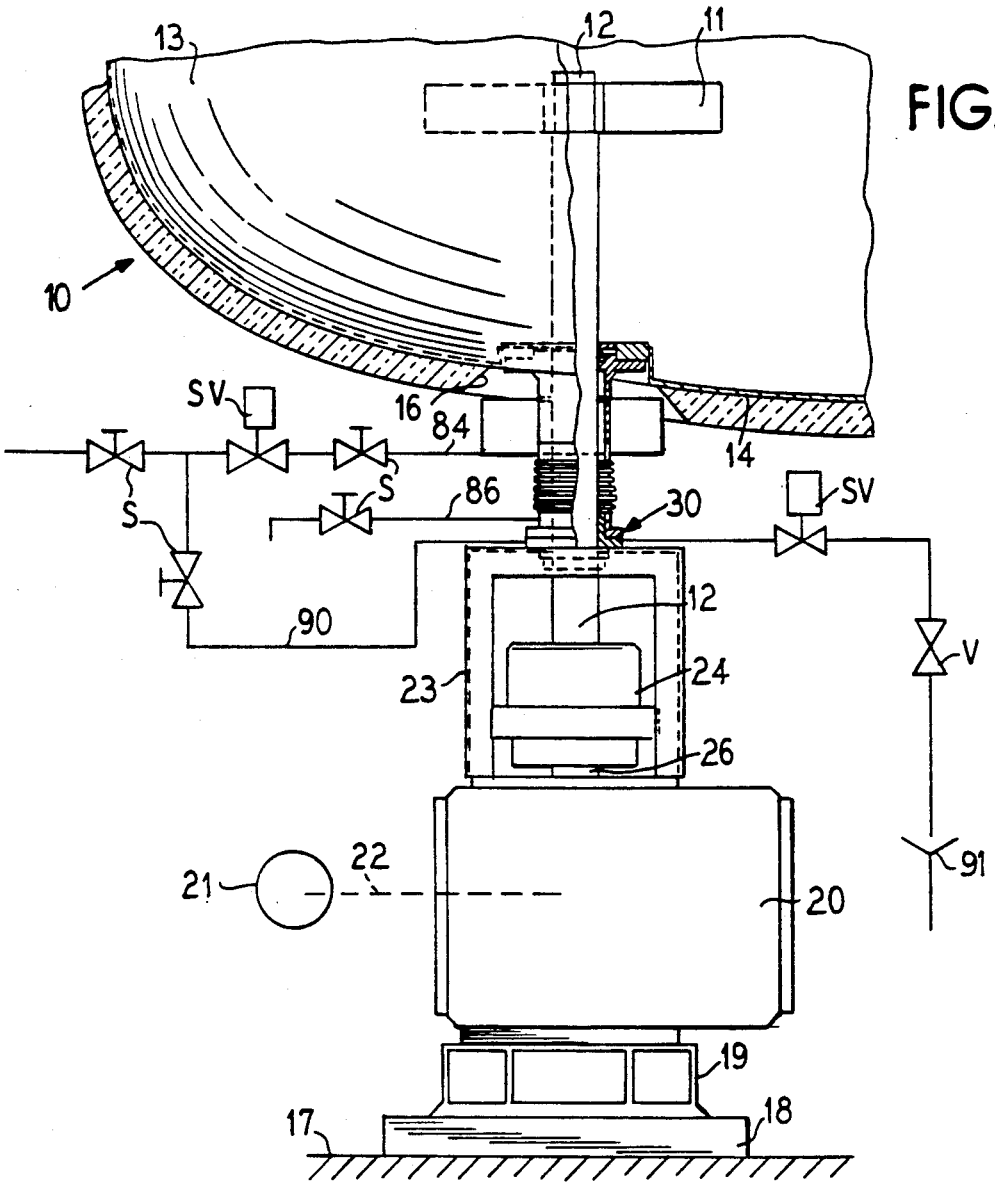
FIG. 1
FIG. 3
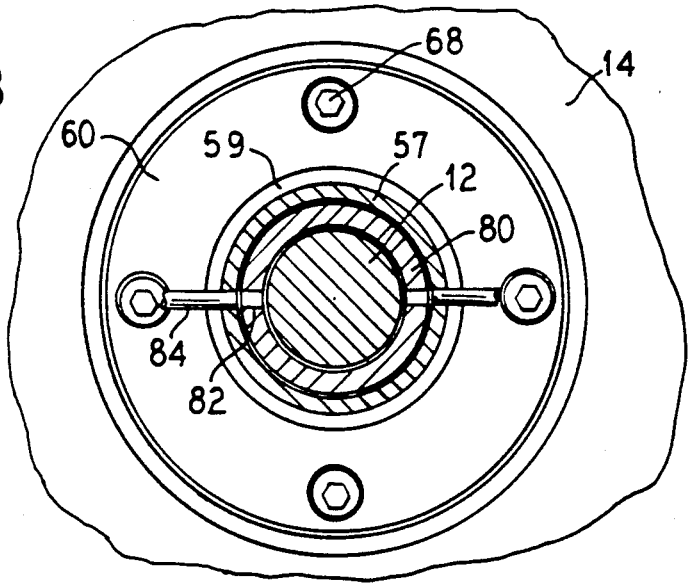

BOTTOM ENTRY MIXER SHAFT SEAL SYSTEM FOR PROCESS VESSELS

BACKGROUND OF THE INVENTION

1. Field of the Invention

This invention pertains generally to vessels similar to mash vessels and cereal cookers and more specifically to a mixer shaft sealing system for vessels having a bottom entry mixer shaft.

2. Description of the Prior Art

Brewery vessels having bottom entry drive seals are notoriously plagued by problems directly attributable to the drive seals. The conventional seal usually consists of a stuffing box, a gland follower and packing with seals. Water is injected between the shaft and packing and seal to keep the shaft clear of abrasive grit material.

However, due to wear and the vertical and dynamic movement of the brewery vessel during the normal course of the brewing function, the product content from the vessel, for example either the mash in a mash vessel, or the cereal in a cereal cooker will escape from the vessel along the mixer shaft and through the drive seal.

Any leakage of that kind results in leakage into the gear box containing the drive train with all of the consequences of high maintenance costs and down time should such elements need special attention.

The inability of the drive seal to accommodate axial and radial movements also subjects the mixer shaft to high torque loading, thereby causing high amperage requirements on the drive motor whereupon the drive motors will often cut out on overload.

Product leakage along the seals will also cause scoring of the packing and the shaft due to the abrasiveness of the product contents of the brewing vessel.

As a result of the foregoing, high energy costs are incurred and unacceptable unsanitary conditions are produced in the brewing environment.

SUMMARY OF THE INVENTION

A sealing system for a vessel of the type having a bottom entry drive for a mixer shaft is provided in accordance with the present invention wherein a commercially available motion seal is installed exteriorly of the vessel and a mechanical seal is installed at the bottom wall of the vessel, thereby to provided longitudinally spaced apart seals along the length of the mixer shaft. However, that motion seal is augmented and supplemented by a bellows expansion piece formed as part of a cylindrical tube having an upper rigid cylinder ring and a lower rigid cylinder ring, both seating "TEFLON" or similar bushings in close running relation with the adjoining surfaces of the mixer shaft and forming radial through passages for accommodating the flow of a flushing water stream.

The upper end of the tube is connected to a mechanical shaft seal fastened directly to the vessel. The seal system is provided with a water flushing system and is fitted with solenoid control valves for controlling the flow of flushing water to the exterior motion valve as well as to the upper and lower bushings.

BRIEF DESCRIPTION OF THE DRAWINGS

FIG. 1 is a side view showing a fragmentary sectional part of a brewery vessel such as a mash vessel or a cereal cooker and characterized by a bottom entry mixer shaft and utilizing a sealing system in accordance with the present invention;

FIG. 3 is a fragmentary cross-sectional view taken on the plane of line III—III of FIG. 2;

DESCRIPTION OF THE PREFERRED EMBODIMENTS

Figure 2:
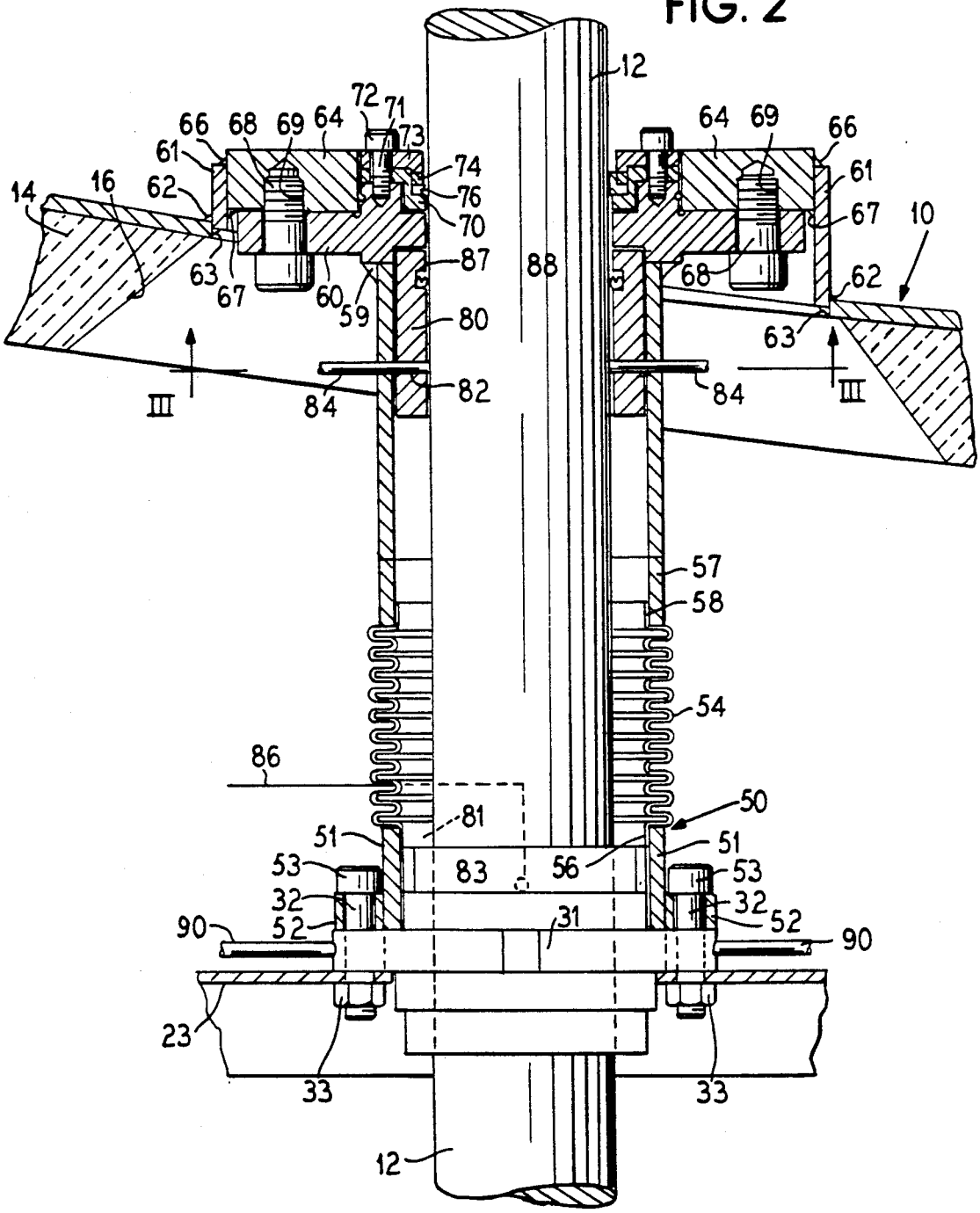
FIG. 2 is an enlarged fragmentary cross-sectional view showing additional details of the sealing system of the present invention.

Referring to the drawings, a typical vessel is shown generally at 10 and may comprise a mash vessel or a cereal cooker. In such a vessel 10 there is provided a mixer 11 co-rotatably connected to the end of a mixer shaft 12 disposed on a generally vertical axis. The mixer 11 is for the purpose of stirring the contents of the vessel and thereby insuring a circulatory flow of the contents of the vessel during the operation of the process for which the vessel 10 is adapted.

The vessel 10 has side walls 13 which are shaped to blend curvately into a bottom wall 14. The bottom wall 14 has an opening 16 adapted to accommodate the entry into the interior of the vessel 10 of the vertically disposed mixer shaft 12, thereby giving the vessel the characteristics of a so-called bottom entry mixer shaft.

A floor or support surface 17 in the plant supports the vessel by support means not shown in the drawings and in addition carries a platform 18 from which rises a lower support framework 19 mounting a gear box 20 housing the drive train (not shown) through which the mixer shaft 12 is rotatably driven by an electric drive motor shown schematically at 21 and which is coupled in driving relation to the drive train in the gear box as shown by the coupling 22 depicted in dotted lines.

An upper support framework 23 is disposed above the gear box 20 and below the vessel 10. Situated within the upper support framework 23 is a coupling 24 joining a drive shaft 26 projecting upwardly out of the top of the gear box 20 in co-rotatable relation with the mixer shaft 12.

In a conventional installation, the bottom entry mixer shaft is sealed by means of a stuffing box, gland follower and packing with seals. Water is injected between the shaft and packing and seal to keep the shaft clear of abrasive grit material. However, such a sealing arrangement has proved inadequate since there is an inability to accommodate the axial and radial movements which result from the vessel 10 deflecting due to thermal and dynamic loading. Consequently, the contents of the vessel leak down into the gear box, interfering with the operation of the drive train and contaminating the environment in and around the vessel.

Figure 4:
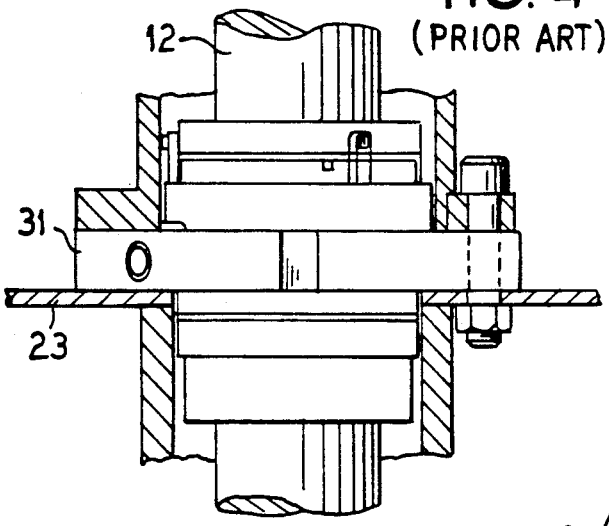
FIG. 4 (PRIOR ART)
FIG. 4 is a partial cross-sectional view of the exterior motion seal obtained from a commercial source.
Figure 5:
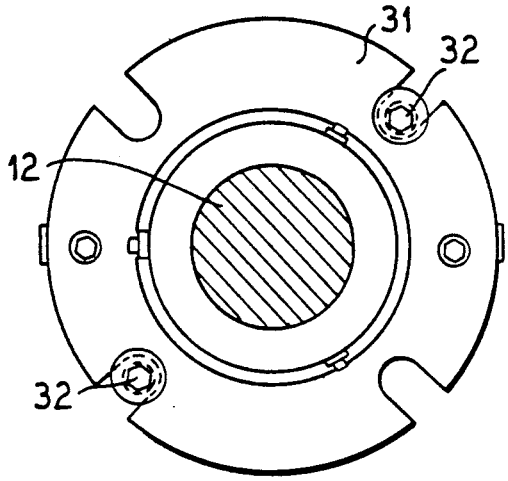
FIG. 5 (PRIOR ART)
FIG. 5 is a cross-sectional view of the prior art motion seal of FIG. 4 taken on line V—V of FIG. 4.
Figure 6:
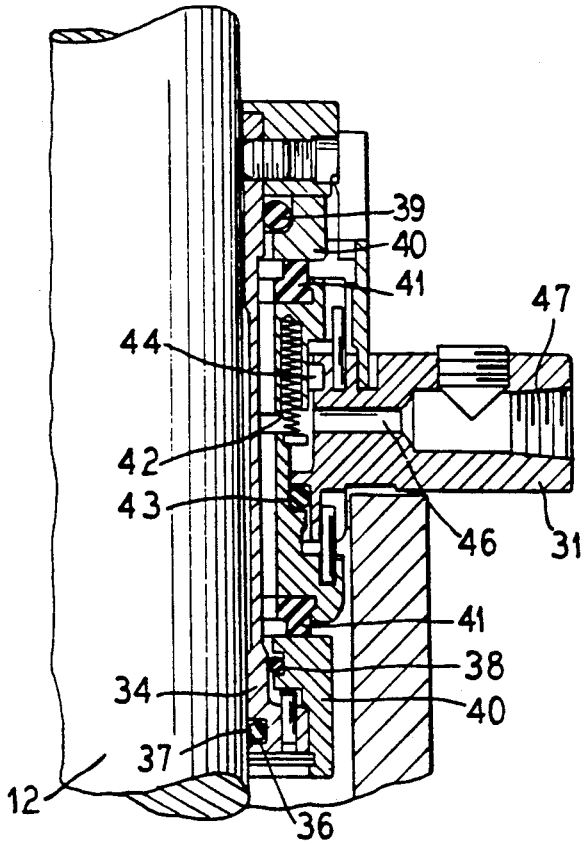
FIG. 6 (PRIOR ART)
FIG. 6 is a fragmentary enlarged view showing additional details of the prior art motion seal of FIGS. 4 and 5.

According to the present invention there is provided a novel sealing system between the upper framework 23 and the bottom wall 14 of the vessel 10. First of all, a commercially available motion seal is provided, the details of which are illustrated in FIGS. 4, 5 and 6 and the general outlines of which are identified in FIGS. 1 and 2 at 30. Such a motion seal 30 is obtainable under the commercial name of a Chesterton 222 Motion Seal. It is described as a double balanced stationary seal.

The motion seal 30 has a mounting ring 31 which is connected in firm assembly with the upper support framework 23 by means of a plurality of bolts 32 threaded to receive fastening nuts 33 thereon. Interiorly, the motion seal has a cylindrical shaped ring 34 grooved at 36 to seat an O-ring 37 which engages the exterior surface of the mixer shaft 12. Additional O-rings 38 and 39 engage the outer faces of the ring 34 and in turn, engage a ring member 40, which also presents a radial face for engagement by a carbon seal ring 41. Spring means are shown at 42 for biasing the carbon ring elements outwardly. O-ring members 43 and 44 complete the seal relative to the mounting ring 31.

A conduit passage 46 is formed in the mounting ring 31 and has coupling means formed in the end thereof as at 47 thereby facilitating connection to a water flushing system. The passage 46 carries a stream of flushing water to spaces between the O-rings 37 and 39 and around the mixer shaft 12 within the motion seal 30. The motion seal 30 is effective in accommodating only minor movements of the mixer shaft 12.

In order to accommodate vertical vessel movement without impairing the integrity of the sealing system, it is contemplated that there be provided additional and supplemental sealing means integrally combined with the motion seal 30. Thus, referring to FIGS. 1 and 2, it will be noted there is provided an upright cylindrical tube 50 spaced concentrically outwardly of the mixer shaft 12 and which includes a rigid lower ring 51 flanged as at 52 for attachment to the mounting ring 31 of the motion seal 30 by means of the bolt fasteners 32, each of the heads 53 on the bolts 32 engaging against the upper face of the flange 52.

The cylindrical tube 50 has an intermediate bellows expansion piece 54 which accommodates relatively large vertical vessel movements, and is spaced concentrically outwardly of the mixer shaft 12 sufficiently that relative radial movements are accommodated as well. The bellows expansion piece 54 is connected to the lower rigid ring 51 as at 56 and is correspondingly connected at its upper end to an upper rigid ring 57 as at 58.

The upper end of the upper rigid ring 57 of the cylindrical tube 50 is connected in firm sealed assembly as by a weldment 59 to a bearing retainer ring 60.

Surrounding the opening 16 in the bottom wall 14 of the vessel 10 is an upstanding outer ring 61 which is sealingly connected to the edges of the opening 16 in firm assembly therewith, for example by a first weldment 62 and a second weldment 63. An inwardly extending radial ring 64 is sealingly connected in firm assembly with said upstanding outer ring 61 by means of an upper weldment 66 and a lower weldment 67.

The bearing retainer ring 60 is fastened in firm assembly with the radial ring 64 by means of a plurality of circumferentially spaced screws 68 which are threaded into correspondingly threaded recesses 69 formed in the radial ring 64.

A "Z" shaped retainer 70 is connected to the radial ring 60 by a plurality of circumferentially spaced screws 71 having screw heads 72 which function to press a clamping ring 73 into clamping assembly for a seal ring 76 adapted to engage the adjoining surface of the mixer shaft 12.

The sealing system also includes a bushing 80 mounted at the upper end of the rigid ring 57 made of a low friction plastic material such as polytetrafluoroethylene and marketed under the trademark "TEFLON". The bushing 80 is formed with radial passage means 82, which is connected by appropriate conduit means 84 of a water flushing network. The "TEFLON" bushing 80 is grooved as at 87 to seat an extended wiper 88 for engaging the mixer shaft 12 thereby permitting the bushing 80 to be disposed in a relatively close running relation with the adjoining surfaces of the mixer shaft 12.

A water flushing network is provided which also includes a conduit means 90 connected to the passage 46 (see FIG. 6) by way of the coupling 47 in the motion seal 30. The water flushing network includes various valves V and solenoid actuated valves SV in the conduit means and indicated schematically in FIG. 1 of the drawings, by means of which a stream of flushing water may be directed to the bushing 80 as well as to the motion seal 30 and exhausted to a drain shown at 91.

By virtue of the provisions made in accordance with the foregoing disclosure, an actual installation in an operating brewery indicated a greatly reduced torque on the mixer shaft 12 and amperage readings which for the prior art arrangements were reduced by forty percent at low speed operation and more than twenty three percent at high speed operation. This was a significant improvement in energy consumption and stoppages due to overload of the driving motor 21 were eliminated.

In addition, to the energy savings, the gearbox 20 under the brewery vessel 10 required little maintenance other than routine oil changes, thereby greatly extending the life of the gearbox bearings and of the drive train within the gear box.

Leakage of the contents of both mash vessels and cereal cookers having bottom entry mixer shaft drive systems has been stopped resulting in a much cleaner area under the brewery vessels and thereby significantly improving the cleanliness of the brewing environment.

Although various modifications might be suggested by those versed in the art, it should be understood that I wish to embody within the scope of the patent warranted hereon all such modifications as might be embraced within the scope and the spirit of the appended claims.

I claim as my invention:

1. A vessel having bottom and upstanding side walls for holding product and a bottom entry mixer shaft extending vertically through said bottom wall to provide an inner end inside of said vessel; and an outer end extending into an area subjacent said vessel;

a rotatable mixer blade on the inner end of said mixer shaft and connected thereto in co-rotatable relation therewith for stirring the contents of said vessel and thereby to insure the circulatory flow and agitation of the contents therein;

a gear box having motor driven gear power train coupled in driving relationship to the outer end of said mixer shaft, said vessel deflecting during utilization thereof in operation due to thermal and dynamic loading; and motion sealing means between said vessel and said mixer shaft at an intermediate portion of said shaft between said inner and outer ends, comprising:

a mechanical seal having an outer upstanding ring sealingly connected in firm assembly to the edges of a bottom opening formed in said bottom walls of said vessel;

an inwardly extending radial ring sealingly connected to said upstanding ring and extending radially inwardly but having a center opening of sufficient size to freely pass said mixer shaft therethrough;

a bearing retainer ring connected to said radial ring and retaining in assembly therewith a shaft seal engaging the radially inwardly adjoining surfaces of said mixer shaft; and additional motion seal means comprising a cylinder having a rigid upper end connected in firm sealed assembly to said bearing retainer ring and spaced concentrically outwardly of said mixer shaft, said cylinder having an intermediate longitudinally expandable bellows spaced concentrically outwardly of said mixer shaft and a rigid lower end connected in firm sealed assembly to a double balanced stationary seal;

a support framework between said gear box and said stationary seal and connected in assembly with both;

a low friction plastic bushing between said rigid upper end of said cylinder and said mixer shaft, said bushing being internally grooved and carrying an extruded wiper engaging the adjoining surface of said mixer shaft;

a water flushing means comprising conduit means connected to said rigid upper ring and to said bushing and to said double balanced stationary seal; and solenoid controlled valves in said conduit means to control the flow of water to the bushings and to the stationary seal;

whereby axial and radial movements of the vessel are accommodated without significant leakage of the contents past the mixer shaft and the sealing system provided therefor.

2. In a bottom entry mixer shaft vessel having a bottom wall an improved sealing system, comprising, a first motion seal exteriorly of the vessel and surrounding the mixer shaft;

a second mechanical seal at the bottom wall of the vessel and surrounding the mixer shaft at a location spaced above the first motion seal; and cylindrical tube means interconnecting said first and second seals including an intermediate bellows expansion piece to accommodate for vertical vessel movement and further including an upper rigid ring having a low friction bushing in close running relationship with said mixer shaft; and a water flushing means to said bushing and to said motion seal to keep the mixer shaft free of abrasive grit materials.

3. For use in a bottom entry mixer shaft vessel, an improved mixer shaft sealing system comprising, first and second spaced apart seals on the mixer shaft; and a multi-part tubular cylinder interconnecting said seals and concentrically spaced outwardly of said mixer shaft and including an upper rigid ring having a low friction plastic bushing in close running relation with the mixer shaft and an intermediate bellows expansion piece to accommodate thermal and dynamic movement of the vessel.

4. A brewery vessel assembly comprising, a brewery vessel having a bottom wall formed with a bottom opening;

a mixer shaft extending vertically through said bottom opening and having mixer blades connected to the upper end of said mixer shaft to stir the contents of the vessel;

a gear box enclosing a drive train below said vessel and having a drive shaft extending upwardly therefrom coupled to the lower end of said mixer shaft;

electric motor means drivingly connected to said drive train to rotatably power said mixer shaft;

a support framework connected to said gear box;

a first motion seal mounted on said support framework and surrounding said mixer shaft to accommodate limited movement of said shaft while providing a seal for the shaft;

a second mechanical seal mounted in the bottom wall of the vessel and surrounding said mixer shaft to provide a seal for the shaft; and a cylindrical bellows expansion piece concentrically outwardly spaced of said mixer shaft and having a lower rigid ring connected to said first motion seal and an upper rigid ring connected to said second mechanical seal;

said expansion piece having a "TEFLON" bushing inwardly of one of said rigid rings in close running relationship with said mixer shaft;

whereby thermal and dynamic movement of the vessel is accommodated by the sealing system without leakage of the vessel contents past the sealing system.

5. A vessel assembly as defined in claim 4 and further characterized by a water flushing network fitted with solenoid valves and connected to said bushings and to said first motion seal to flush abrasive grit from around the mixer shaft.

* * * * *